US009551160B2

(12) United States Patent
Gealy

(10) Patent No.: US 9,551,160 B2
(45) Date of Patent: Jan. 24, 2017

(54) SCAFFOLD AND METHOD

(71) Applicant: Preston L. Gealy, New Castle, PA (US)

(72) Inventor: Preston L. Gealy, New Castle, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 15/195,611

(22) Filed: Jun. 28, 2016

(65) Prior Publication Data

US 2016/0305137 A1 Oct. 20, 2016

Related U.S. Application Data

(62) Division of application No. 12/660,417, filed on Feb. 26, 2010, now Pat. No. 9,388,588.

(51) Int. Cl.

| | |
|---|---|
| ***E04G 1/30*** | (2006.01) |
| ***E04G 7/22*** | (2006.01) |
| ***E04G 5/00*** | (2006.01) |
| ***E04G 1/28*** | (2006.01) |
| *E04G 1/24* | (2006.01) |

(52) U.S. Cl.

CPC . *E04G 7/22* (2013.01); *E04G 1/28* (2013.01); *E04G 1/30* (2013.01); *E04G 5/00* (2013.01); *E04G 2001/242* (2013.01)

(58) Field of Classification Search

CPC ..... E04G 1/28; E04G 1/30; E04G 5/00; E04G 5/004; E04G 7/28; E04G 1/154; E04G 2001/302; E04G 2001/305; E04G 2001/242; E06C 1/397

USPC ..... 182/115–119, 141

See application file for complete search history.

(56) References Cited

U.S. PATENT DOCUMENTS

| | | | | |
|---|---|---|---|---|
| 4,262,774 | A * | 4/1981 | Chez | E04G 1/20 182/119 |
| 4,793,438 | A * | 12/1988 | Perry | E04G 1/20 182/112 |
| 5,069,309 | A * | 12/1991 | Swiderski | E04G 1/20 16/30 |
| 5,368,126 | A * | 11/1994 | Woodward | E04G 1/34 182/118 |
| 5,390,761 | A * | 2/1995 | Perry | E04G 1/20 182/118 |
| 5,988,317 | A * | 11/1999 | Riding | E04G 1/15 182/152 |
| 6,832,666 | B2 * | 12/2004 | Stringer | E04G 1/20 182/118 |
| 2003/0010569 | A1 * | 1/2003 | Wyse | E04G 1/154 182/118 |

(Continued)

*Primary Examiner* — Daniel Cahn

(74) *Attorney, Agent, or Firm* — Ansel M. Schwartz

(57) ABSTRACT

A scaffold includes a first end frame assembly. The scaffold includes a second end frame assembly. The scaffold includes a first side brace assembly supported by the first end frame assembly and the second end frame assembly. The scaffold includes a second side brace assembly supported by the first end frame assembly and the second end frame assembly. Each end frame assembly has a first rail with holes and a caster assembly and a second rail with holes and a caster assembly, and a horizontal that is attached to each rail. Each side brace assembly has a locking pin in proximity to each end which engages with a hole in a respective rail, and an associated guard disposed about each pin. Each locking pin has a handle which has a length that extends below the associated guard on an interior side of the guard. A method for a scaffold.

2 Claims, 6 Drawing Sheets

(56) References Cited

U.S. PATENT DOCUMENTS

| | | | | |
|---|---|---|---|---|
| 2003/0102187 | A1* | 6/2003 | Stringer | E04G 1/20 182/118 |
| 2004/0069568 | A1* | 4/2004 | Wyse | E04G 1/24 182/118 |
| 2004/0188176 | A1* | 9/2004 | Wyse | E04G 1/154 182/118 |
| 2008/0310910 | A1* | 12/2008 | Chick | E04G 1/20 403/49 |

* cited by examiner

SCAFFOLD AND METHOD

CROSS-REFERENCE TO RELATED APPLICATIONS

This is a divisional of U.S. patent application Ser. No. 12/660,417 filed on Feb. 26, 2010, now U.S. Pat. No. 9,388,588, incorporated by reference herein.

FIELD OF THE INVENTION

The present invention is related to a scaffold where each side brace assembly has a locking pin that, has a handle which has a length that extends below an associated guard on an interior side of the guard so the handle cannot be accidentally contacted, causing the pin to loosen and possibly the scaffold to come apart. (As used herein, references to the "present invention" or "invention" relate to exemplary embodiments and not necessarily to every embodiment encompassed by the appended claims.)

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Some portable scaffold units have locking pins that can rotate, leaving the handle portion exposed outside the envelope of the scaffold unit. When the handle portion of the locking pin is exposed, this allows the locking pin to be involuntarily disengaged.

FIG. 1 is a detailed view of the area near a common locking pin assembly. The handle of the locking pin has been rotated to extend outside the envelope of the scaffold unit where it can accidentally be contacted, possibly causing disengagement.

FIG. 6 shows a prior art solution of this problem. A spring and pin design for enabling the side braces to engage the end frames. They have a pin that goes through a guard, C-channel and the end frame. The pin is held in the engaged position by means of a spring. The spring is retained between the guard and a nut that is threaded onto the pin. The pin is in the engaged position at all times unless actuated by the user. The pin is actuated by means of a disk that is connected to the retaining nut. The user places their palm against the guard and places their fingers on the nut side of the disk. They pull the disk towards their palm until the pin disengages. This design has all moving parts within the envelope of the scaffold.

FIG. 7 shows another prior art solution of the aforementioned problem. A spring and pin design is used for enabling the side braces to engage the end frames. They have a pin that goes through a piece of angle, square tubing and a C-channel and the end frame. The pin is held in the engaged position by means of a spring. The spring is retained between the piece of angle and the square tubing. The pin is connected to the spring by means of a roll pin. The pin is actuated by means of a handle at one end. The pin is in the engaged position at all times unless actuated by the user. The user pulls the handle away from the end frame to disengage. The handle of the pin is free to rotate outside the envelope of the scaffold unless the user locks it in place. The handle is locked in place by pushing the handle towards the end frame and hooking it onto the piece of angle. This design locks all moving parts from being able to rotate outside the envelope of the scaffold.

The present invention involves a new locking pin design that will prevent the handle portion from rotating outside of the envelope of the scaffold.

BRIEF SUMMARY OF THE INVENTION

The present invention pertains to a scaffold. The scaffold comprises a first end frame assembly. The scaffold comprises a second end frame assembly. The scaffold comprises a first side brace assembly supported by the first end frame assembly and the second end frame assembly. The scaffold comprises a second side brace assembly supported by the first end frame assembly and the second end frame assembly. Each end frame assembly has a first rail with holes and a caster assembly and a second rail with holes and a caster assembly, and a horizontal that is attached to each rail. Each side brace assembly has a locking pin in proximity to each end which engages with a hole in a respective rail, and an associated guard disposed about each pin. Each locking pin has a handle which has a length that extends below the associated guard on an interior side of the guard.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
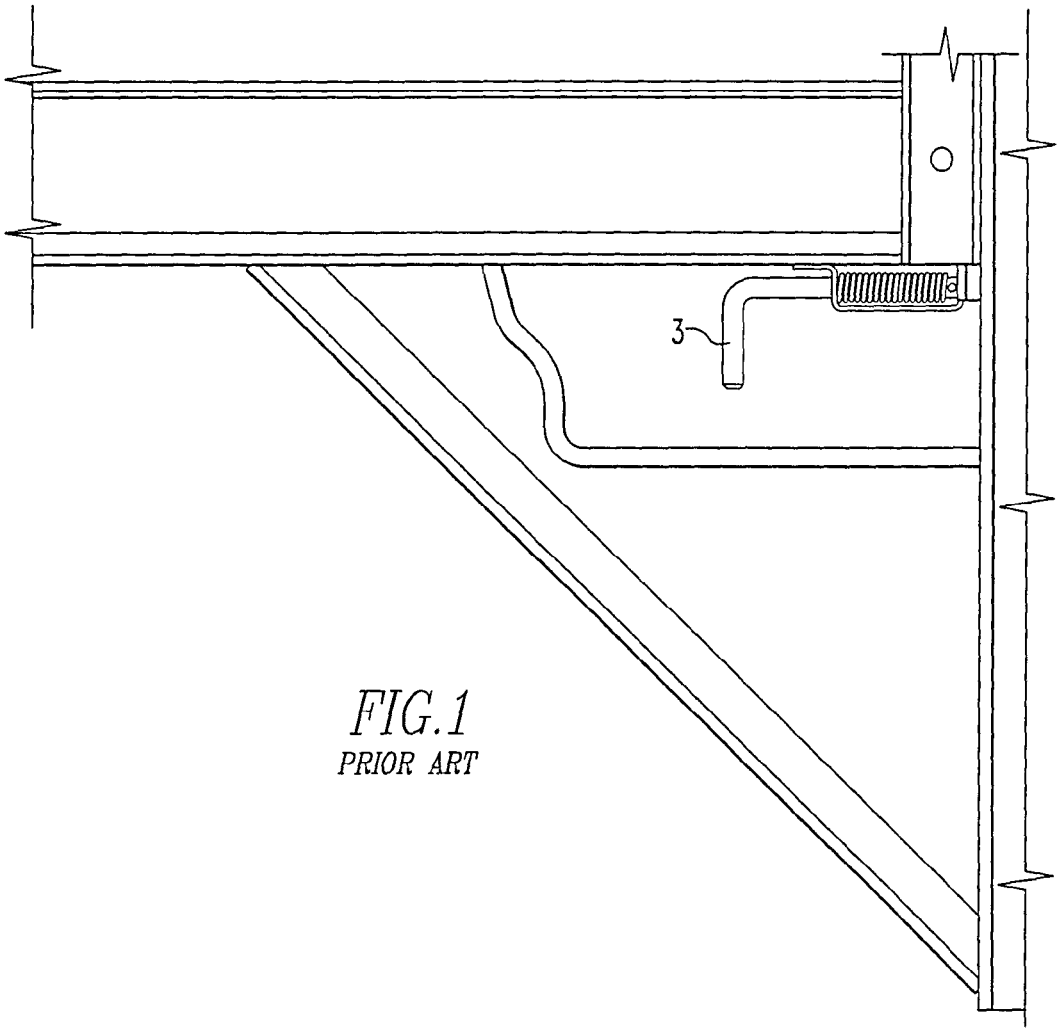
FIG.1 PRIOR ART
FIG. 1 shows a prior art scaffold and a locking pin.

Referring now to the drawings wherein like reference numerals refer to similar or identical parts throughout the several views, and more specifically to FIGS. 2-5 thereof, there is shown a scaffold. The scaffold comprises a first end frame assembly 2*a*. The scaffold comprises a second end frame assembly 2*b*. The scaffold comprises a first side brace assembly 1*a* supported by the first end frame assembly 2*a* and the second end frame assembly 2*b*. The scaffold comprises a second side brace assembly 1*b* supported by the first end frame assembly 2*a* and the second end frame assembly 2*b*. Each end frame assembly has a first rail 19 with holes 17 and a caster assembly 23 and a second rail 21 with holes 17 and a caster assembly 23, and a horizontal 15 that is attached to each rail. Each side brace assembly has a locking pin 3 in proximity to each end which engages with a hole 17 in a respective rail, and an associated guard 8 disposed about each pin. Each locking pin 3 has a handle which has a length that extends below the associated guard 8 on an interior side of the guard 8.

The scaffold may include latch pins 5 which hold a deck 4 onto the side braces. Each side brace may have a bracket 25 in proximity to each end through which the respective pin extends. Each side brace assembly may have a channel 27 at either end which contacts the respective rail. Each side brace assembly may have a knee brace 29 at either end that extends from the channel 27.

The present invention pertains to a method for a scaffold. The method comprises the steps of placing a locking pin 3 in proximity to either end of a first side brace assembly 1*a* into a hole 17 of a first rail 19 of a first end frame assembly 2*a* and a hole 17 of a first rail 19 of a second end assembly, respectively, so the first end frame assembly 2*a* and the second end frame assembly 2*b* supports the first side brace assembly 1*a*. There is the step of positioning a handle of the pin on either end of the first side brace assembly 1*a* having a length which extends below a guard 8 in proximity to either end of the first side brace assembly 1*a*, respectively, on an interior side of the guard 8. There is the step of placing a locking pin 3 in proximity to either end of a second side brace assembly 1*b* into a hole 17 of a second rail 21 of the first end frame assembly 2*a* and a hole 17 of a second rail 21 of the second end assembly, respectively, so the first end frame assembly 2*a* and the second end frame assembly 2*b* supports the second side brace assembly 1*b*. There is the step of positioning a handle of the pin on either end of the second side brace assembly 1*b* having a length which extends below a guard 8 in proximity to either end of the second side brace assembly 1*b*, respectively, on an interior side of the guard 8.

The placing step can include the step of placing the locking pin 3 disposed in a bracket 25 in proximity to each end of the first side brace assembly 1*a* into the hole 17 of the first rail 19 of the first end frame assembly 2*a* and the hole 17 of the first rail 19 of the second end assembly, respectively, so the first end frame assembly 2*a* and the second end frame assembly 2*b* supports the first side brace assembly 1*a*.

Figure 2:
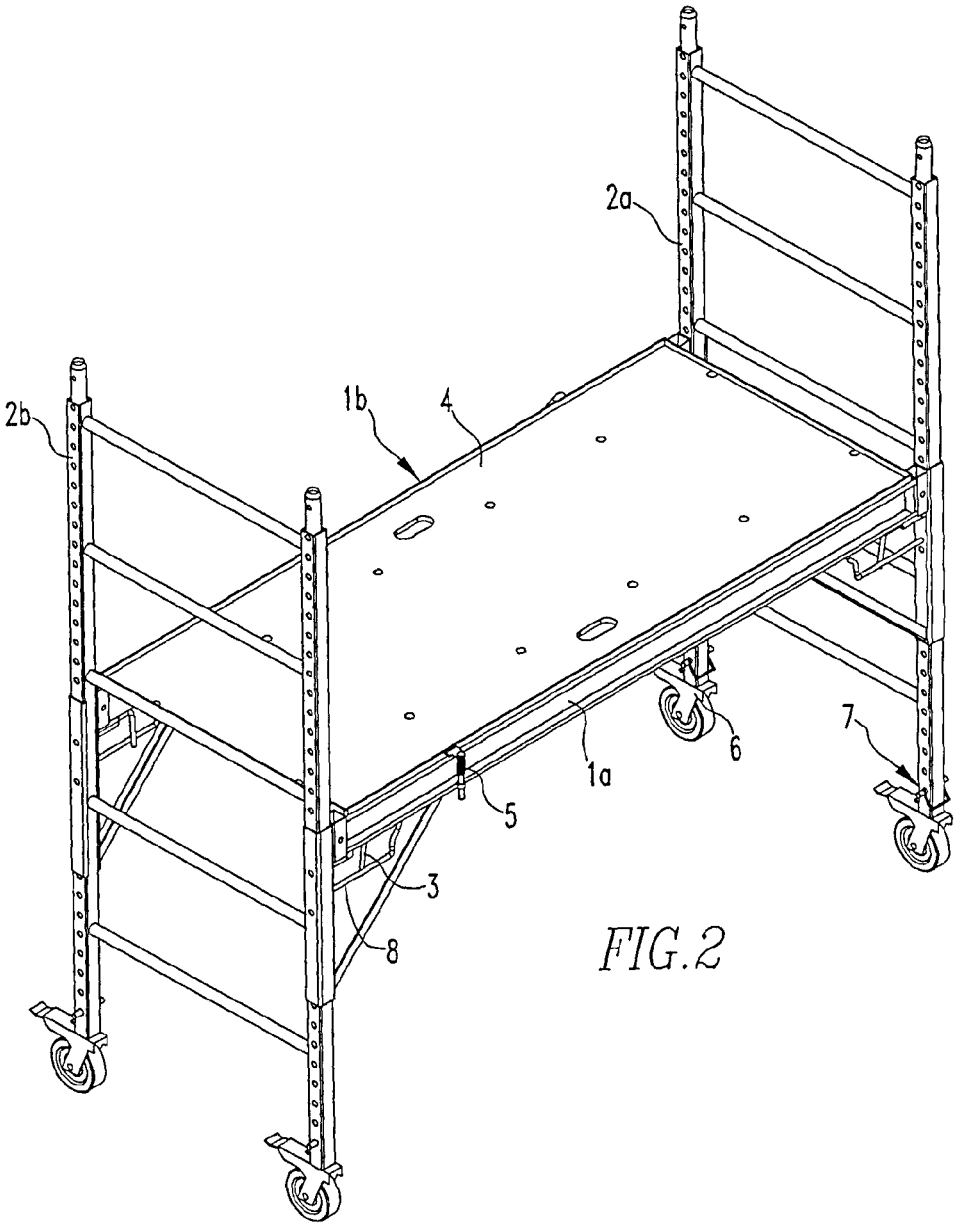
FIG. 2 shows a scaffold of the present invention.

In the operation of the invention, a simplified steel rolling scaffold is shown in FIG. 2. There are two side brace assemblies 1*a*, 1*b* connected to two end frame assemblies 2*a*,2*b* via four locking pins 3. There is a plywood deck 4 that is secured to the side braces via two latch pins 5. There are four caster assemblies 6 that are secured to the end frames 2 via four snap pins 7.

Figure 3:
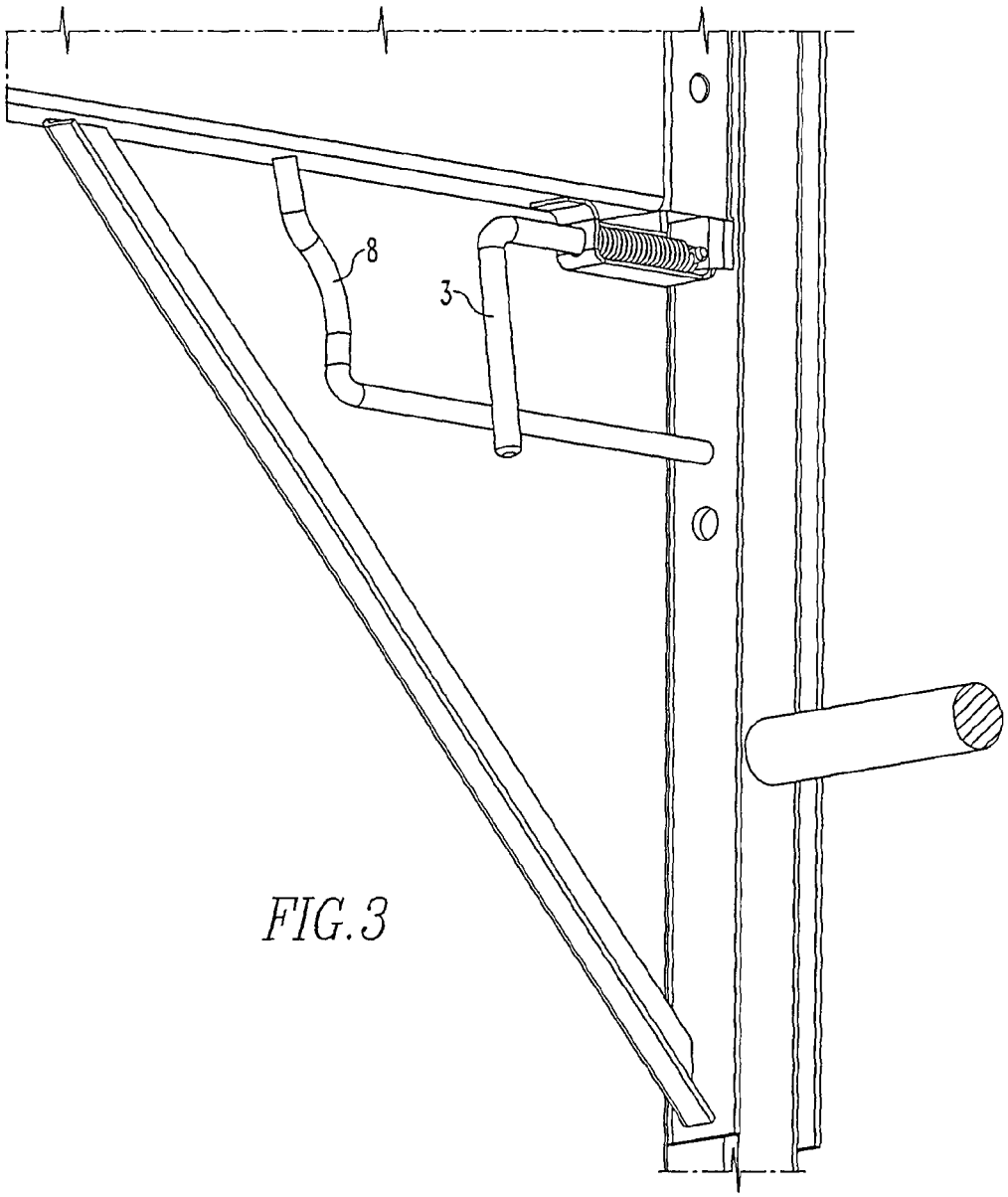
FIG. 3 shows a locking pin guard relationship of the present invention.
Figure 4:
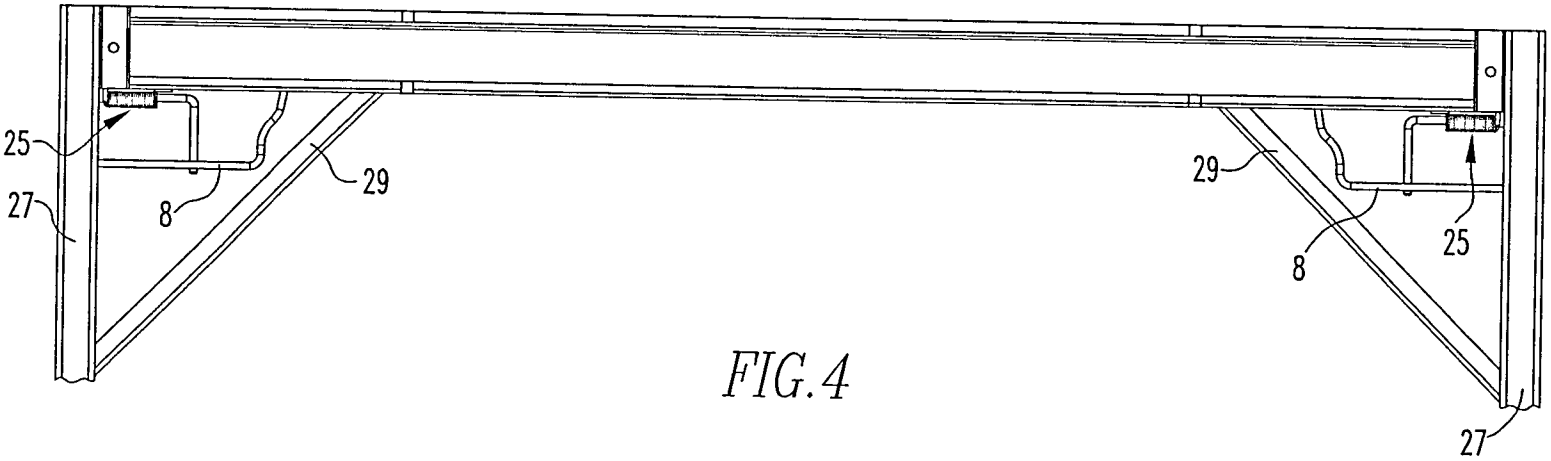
FIG. 4 shows a side brace assembly.
Figure 5:
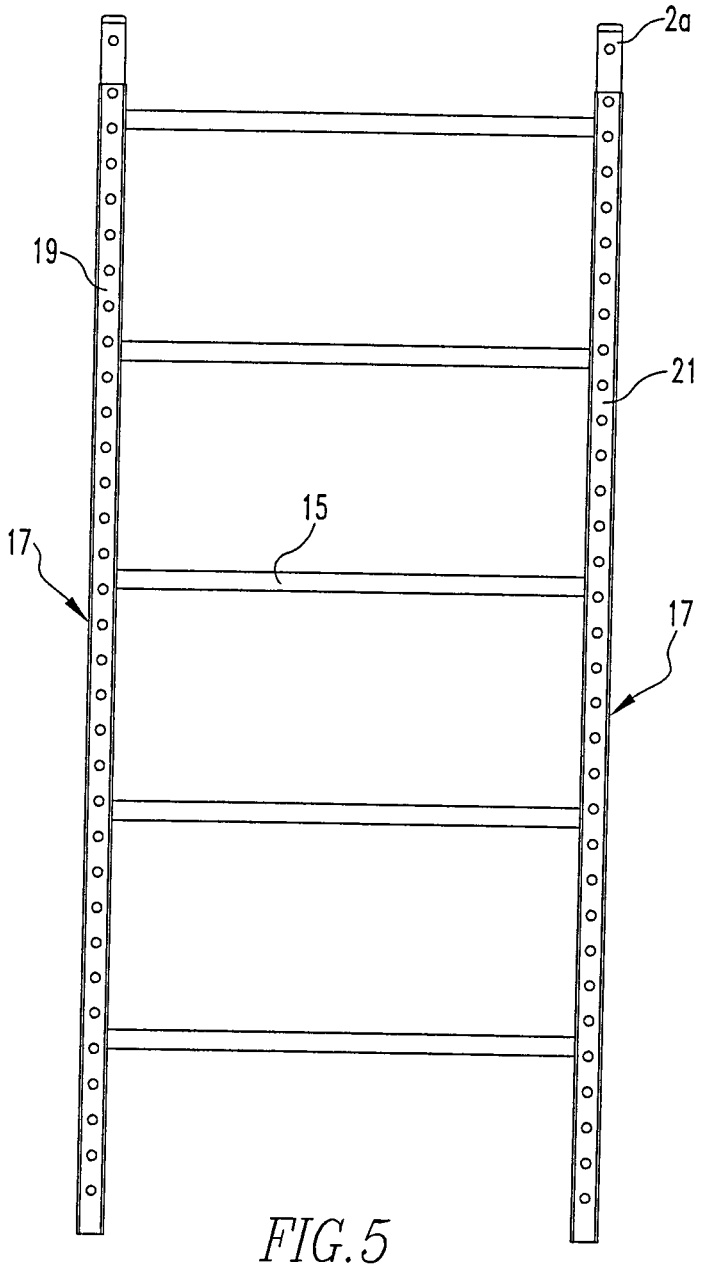
FIG. 5 shows an end frame assembly.
Figure 6:
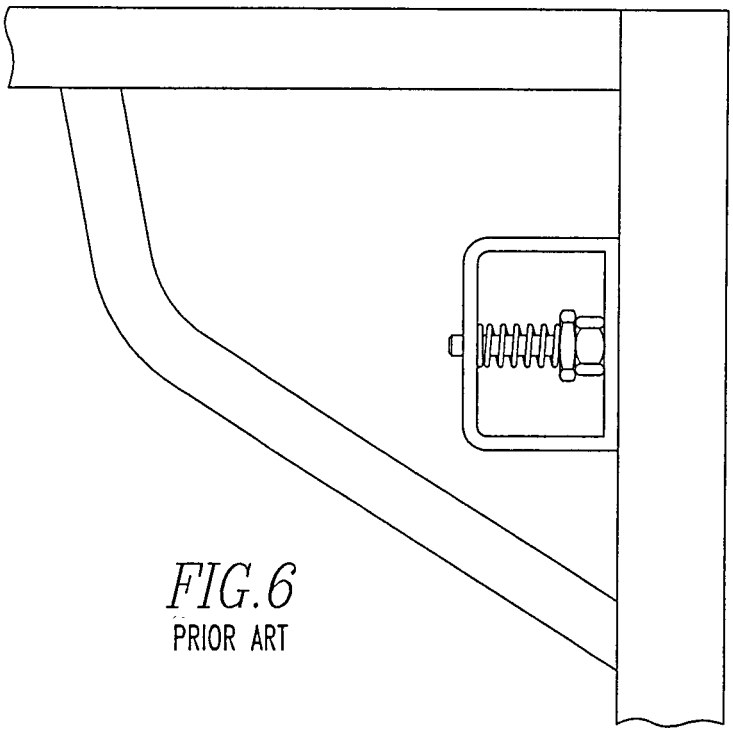
FIG. 6 PRIOR ART
FIG. 6 shows a prior art solution to the problem the present invention also solves.
Figure 7:
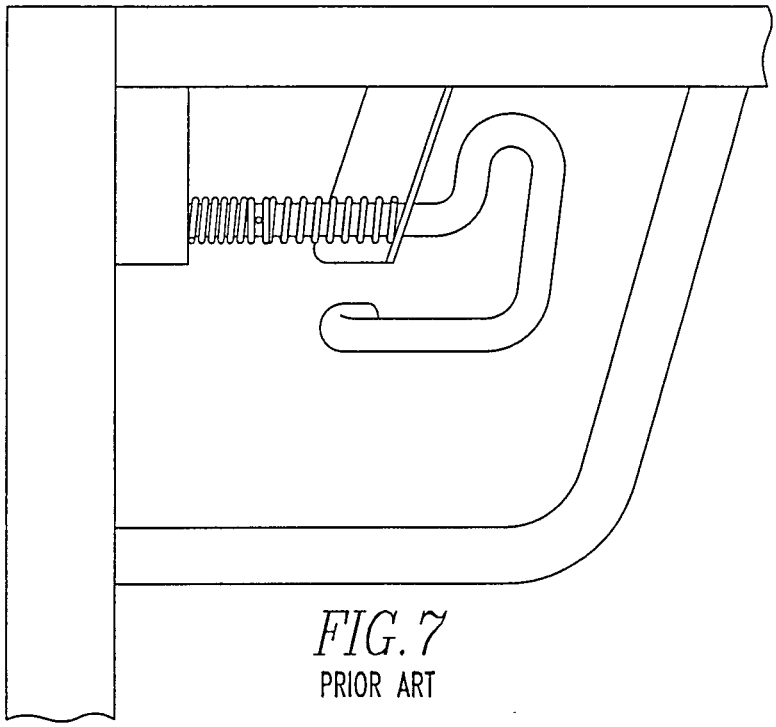
FIG. 7 PRIOR ART
FIG. 7 shows a prior art solution to the problem the present invention also solves.

FIG. 3 is a detailed view of the area near the locking pin 3. Notice the length of the handle has been extended below the guard 8. The locking pin 3 is assembled on the interior side of the guard 8 so that the handle of the locking pin cannot rotate beyond the guard 8.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A method for a scaffold, the method comprising the steps of:

providing the scaffold having:

a first end frame assembly having a first vertical rail with holes and a first caster assembly, a second vertical rail with holes and a second caster assembly, and a horizontal rung that is attached between the first and second vertical rails;

a second end frame assembly having third and fourth vertical rails with holes and a horizontal rung attached therebetween;

a first horizontal side brace assembly having a first vertical channel with holes, a second vertical channel with holes, a first horizontal beam connecting said vertical channels, a guard rod extending downwardly from the first beam and directly connected between the first beam and the first vertical channel, a first L-shaped locking pin formed by a first portion having a major length extending substantially orthogonally to a major length of a second portion of the locking pin defining a handle, wherein the first horizontal side brace assembly is supported by the first and third vertical rails of the first and second end frame assemblies, and the first portion of the locking pin is configured to removably pass through the holes of the first vertical rail and the first vertical channel to adjustably lock the first horizontal side brace assembly at different heights along the first end frame assembly;

a second horizontal side brace assembly supported by and extending between the second and fourth vertical rails of the first and second end frame assemblies;

all elements of the guard rod, the first portion of the locking pin, the vertical channels, the first vertical rail, the third vertical rail and the first beam lie within and define a first vertical plane;

all elements of the second vertical rail, the fourth vertical rail and the second side brace assembly lie within and define a second vertical plane that is substantially parallel to the first vertical plane; and the major length of the first portion of the locking pin is configured to pivot about a horizontal axis which only extends within the first vertical plane so that the second portion of the locking pin moves towards the second vertical plane to be positioned into a space located between said vertical planes, wherein the guard rod is positioned below the first portion of the locking pin a distance less than the major length of the second portion of the locking pin and the first beam is positioned above the first portion of the locking pin a distance less than the major length of the second portion of the locking pin so that the locking pin is directly blocked by one of said first horizontal beam and said guard rod when the second portion of the locking pin is moved in a direction away from said second vertical plane, and wherein the locking pin is incapable of moving beyond an opposite side of said first vertical plane with respect to said second vertical plane;

placing the first locking pin in proximity to a first end of said first horizontal side brace assembly and into one of said holes of the first vertical rail of the first end frame assembly so that the first end frame assembly supports the first horizontal side brace assembly;

placing a second locking pin in proximity to a second end of said first horizontal side brace assembly and into one of said holes of the third vertical rail of the second end frame assembly so that the second end frame assembly supports the first horizontal side brace assembly;

positioning the handle of the first locking pin so that a length of said handle extends below the guard rod and on an interior side of the guard rod;

positioning a handle of the second locking pin so that a length of said handle of the second locking pin extends below a second guard rod and on an interior side of the second guard rod;

placing a third locking pin in proximity to a first end of said second horizontal side brace assembly and into one of said holes of the second vertical rail of the first end frame assembly so that the first end frame assembly supports the second horizontal side brace assembly;

placing a fourth locking pin in proximity to a second end of said second horizontal side brace assembly and into one of said holes of the fourth vertical rail of the second end frame assembly so that the second end frame assembly supports the second horizontal side brace assembly;

positioning a handle of the third locking pin so that a length of said handle of the third locking pin extends below a third guard rod and on an interior side of the third guard rod; and positioning a handle of the fourth looking pin so that a length of said handle of the fourth locking pin extends below a fourth guard rod and on an interior side of the fourth guard rod.

2. The method as described in claim 1, wherein said step of placing the first locking pin includes disposing of said first locking pin in a first bracket, said step of placing the second locking pin includes disposing of said second locking pin in a second bracket, said step of placing the third locking pin includes disposing of said third locking pin in a third bracket, and said step of placing the fourth locking pin includes disposing of said fourth looking pin in a fourth bracket.

* * * * *